US006205312B1

(12) United States Patent
Kim

(10) Patent No.: US 6,205,312 B1
(45) Date of Patent: Mar. 20, 2001

(54) SQUEEGEE APPARATUS OF LIQUID ELECTROPHOTOGRAPHIC PRINTER

(75) Inventor: Wan-ha Kim, Suwon (KR)

(73) Assignee: Samsung Electronics Co., Ltd., Kyungki-Do (KR)

( * ) Notice: Subject to any disclaimer, the term of this patent is extended or adjusted under 35 U.S.C. 154(b) by 0 days.

(21) Appl. No.: 09/450,732

(22) Filed: Nov. 30, 1999

(30) Foreign Application Priority Data

Apr. 21, 1999 (KR) ..... 99-14270

(51) Int. Cl.[7] ..... G03G 15/10; G03G 15/11; A46B 15/00

(52) U.S. Cl. ..... 399/249; 15/256.51; 399/251

(58) Field of Search ..... 399/237, 249, 399/250, 251, 345, 347, 348; 15/256.51, 256.52

(56) References Cited

U.S. PATENT DOCUMENTS 4,796,048 * 1/1989 Bean ..... 399/249
5,937,249 * 8/1999 Shin ..... 399/249
5,978,631 * 11/1999 Lee ..... 399/251
5,999,775 * 12/1999 Kim ..... 399/251

* cited by examiner

*Primary Examiner*—Arthur T. Grimley
*Assistant Examiner*—Hoang Ngo
(74) *Attorney, Agent, or Firm*—Sughrue, Mion, Zinn, Macpeak & Seas, PLLC

(57) ABSTRACT

A squeegee apparatus of a liquid electrophotographic printer is provided. The apparatus has a squeegee roller for pressing a photoreceptor belt to squeegee excess developer from an image developed on the transfer surface of the photoreceptor belt. A squeegee backup roller is provided opposite to the squeegee roller, to press a reverse surface of the photoreceptor belt. The squeegee apparatus includes a heating device installed in the squeegee backup roller, for heating the photoreceptor belt at a predetermined temperature. During printing, since the photoreceptor belt is squeegeed while it is heated to a predetermined temperature, the squeegeeing efficiency is enhanced, thereby improving the printing quality of the printer.

3 Claims, 3 Drawing Sheets

SQUEEGEE APPARATUS OF LIQUID ELECTROPHOTOGRAPHIC PRINTER

BACKGROUND OF THE INVENTION

1. Field of the Invention

The present invention relates to a squeegee apparatus of a liquid electrophotographic printer.

2. Description of the Related Art

As shown in FIG. 1, a liquid electrophotographic printer such as a color laser printer includes laser scanning units (LSUs) 50 for forming a latent electrostatic image of an image to be developed on a photoreceptor belt 10 by irradiating a laser beam onto the photoreceptor belt 10, development units 20 for developing the latent electrostatic image into a predetermined image using a developer liquid having a liquid solvent mixed with a powdered toner, a drying unit 30 for drying and removing the liquid solvent remaining on the image after development, and a transfer unit 40 for printing the image developed on the photoreceptor belt 10 on a sheet of printing paper (S).

Here, each of the development units 20 includes a development device having a development roller 21, a cleaning brush 24 and a developer liquid supply nozzle 23, and a squeegee apparatus having a squeegee roller 25, a squeegee backup roller 26 and an air spray nozzle 27. The squeegee apparatus squeegees the imaging region of the developed image to remove excess developer liquid therefrom. The excess developer liquid which is not used for development is removed from the photoreceptor belt 10 by the squeegee apparatus.

If the excess developer liquid is not sufficiently withdrawn from the photoreceptor belt 10 by the squeegeeing action of the squeegee roller 25, the operation load of the drying unit 30 is increased. Also, since the image which is not completely dried may migrate to the transfer unit 40, a clean image quality cannot be obtained. Thus, the overall printing quality is influenced by the efficiency of removing the excess developer liquid by the squeegee roller 25, that is, the squeegeeing efficiency.

The squeegeeing efficiency varies with the temperature of the photoreceptor belt 10. When the photoreceptor belt 10 is heated at a temperature of 40 to 45° C., the squeegeeing efficiency is highest. In the printer having the above-described construction, since the photoreceptor belt 10 contacts the respective heated rollers in the drying unit 30 and the transfer unit 40 while the printing operation is carried out, the photoreceptor belt 10 appears to be kept at a high temperature. However, in practice, the photoreceptor belt 10 is rapidly cooled by the heat exchange with the developer liquid while passing through the development units 20 and the contact with the squeegee roller 25, the development backup roller 22 and the squeegee backup roller 26. Thus, it is difficult to keep the photoreceptor belt 10 at a temperature higher than 30° C. while squeegeeing.

Therefore, in order to attain an optimum squeegeeing efficiency, there is an increasing demand for means for keeping a photoreceptor belt at a high temperature while a squeegeeing operation is carried out.

SUMMARY OF THE INVENTION

To solve the above problem, it is an object of the present invention to provide an improved squeegee apparatus of a liquid electrophotographic printer which can heat a photoreceptor belt at a predetermined temperature during a squeegeeing operation.

Accordingly, to achieve the above object, there is provided a squeegee apparatus of a liquid electrophotographic printer having a squeegee roller for pressing a photoreceptor belt to squeegee excess developer liquid from an image developed on the transfer surface of the photoreceptor belt, and a squeegee backup roller for pressing the reverse surface to the transfer surface from the opposite side of the squeegee roller, the squeegee apparatus including a heating means installed in the squeegee backup roller, for heating the photoreceptor belt at a predetermined temperature.

BRIEF DESCRIPTION OF THE DRAWINGS

The above object and advantages of the present invention will become more apparent by describing in detail a preferred embodiment thereof with reference to the attached drawings in which.

DESCRIPTION OF THE PREFERRED EMBODIMENT

Figure 1:
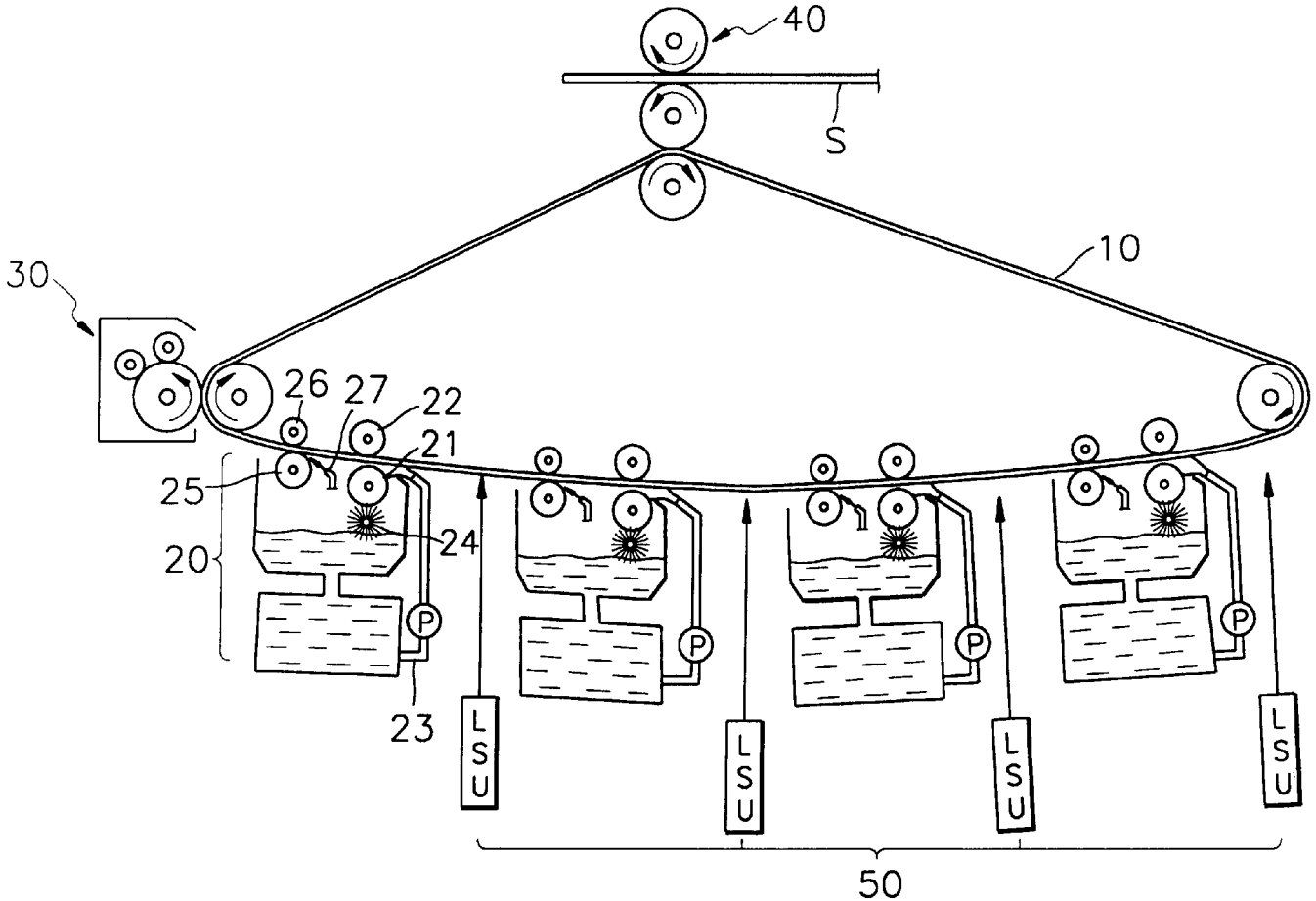
FIG. 1 (PRIOR ART)
FIG. 1 is a schematic diagram illustrating the structure of a liquid electrophotographic printer having a conventional squeegee apparatus.
Figure 3:
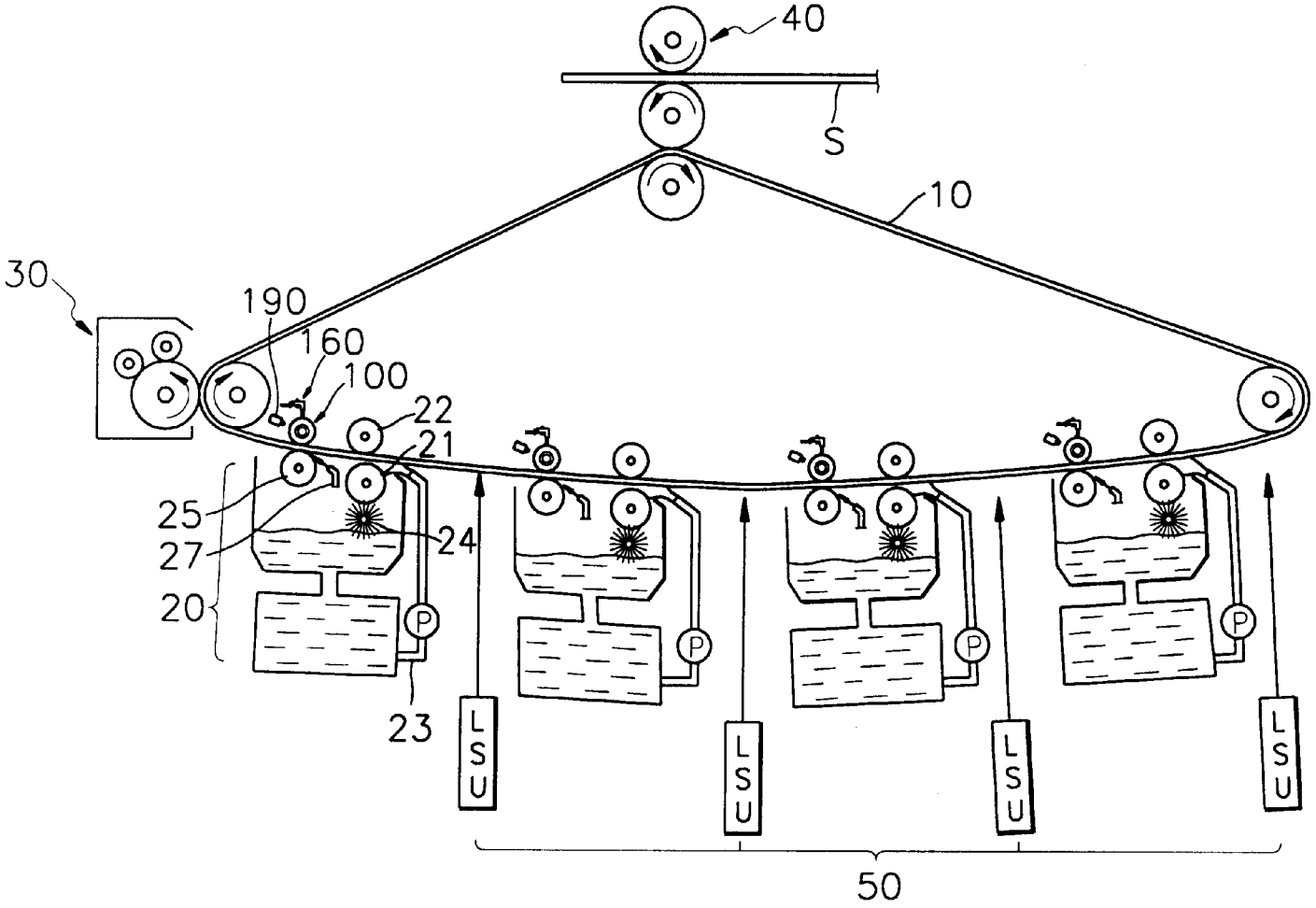
FIG. 3 is a schematic diagram illustrating the structure of a liquid electrophotographic printer having a conventional squeegee apparatus.

In FIG. 3, the same reference numerals as those in FIG. 1 represent the same elements which perform the same functions.

Figure 2:
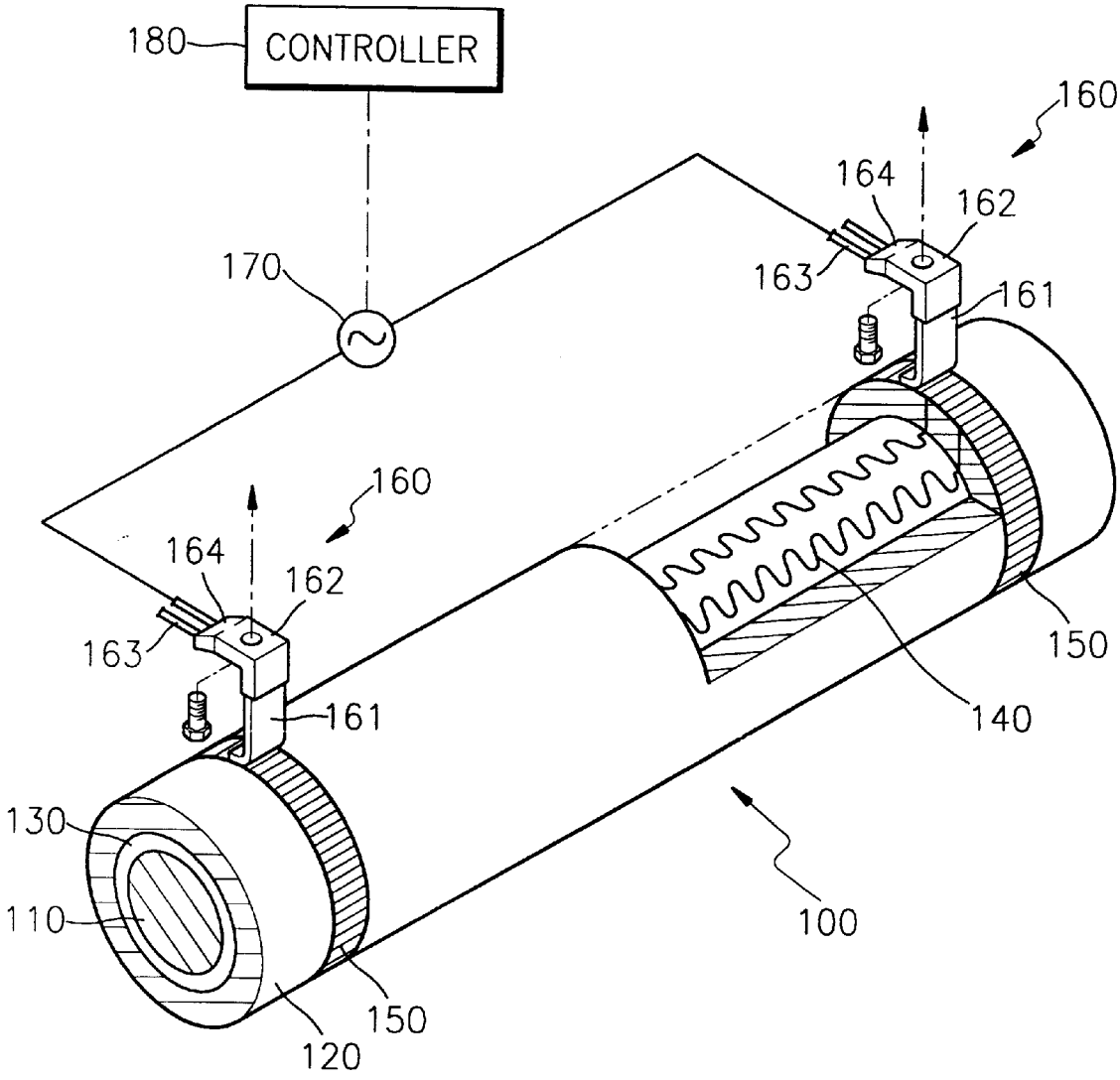
FIG. 2 is a diagram illustrating a squeegee backup roller employed in a squeegee apparatus according to the present invention.

Referring to FIGS. 2 and 3, a heating means for heating a photoreceptor belt 10 is installed in a squeegee backup roller 100 according to the present invention. First, as shown in FIG. 2, the squeegee backup roller 100 has a cross section largely consisting of three layers; a central layer 110 which is a core part, an outer layer 120 which is an outer circumference, and an insulation layer 130 interposed between the central layer 110 and the outer layer 120. The insulation layer 130 insulates a heat wire 140 to be described later from the central layer 110 and a silicon film is appropriately used as the insulation layer 130. Also, the central layer 110 is preferably formed of stainless steel whose hardness and corrosion resistance are good, and the outer layer 120 is preferably formed of polyethylene or polyamide having an appropriate hardness. The heat wire 140 for generating resistance heat when current is supplied is printed on the insulation layer 130. The printed heat wire 140 is formed throughout the entire length of the squeegee backup roller 100 and its both ends are connected to connecting coat units 150 provided on the outer layer 120. Thus, if electricity is supplied to the connecting coat units 150, current flows along the printed heat wire 140.

Reference numeral 160 represents electricity suppliers for supplying electricity to the connecting coat units 150. Each of the electricity supplier 160 includes a holder 162 screw-coupled to a frame (not shown), a supply terminal 161 fixed on the holder 162 such that its free end contacts the connecting coat unit 150, and connecting wires 163 connected to a connection unit 164, for electrically connecting the a power source 170 to the supply terminal 161. One of the connecting wires 163 is connected to the power source 170 and the other is connected to another neighboring squeegee backup roller, which is then connected to still another neighboring squeegee backup roller by another connecting wire. Thus, electricity can be supplied from a single power source to a plurality of squeegee backup rollers.

If the printing operation starts in the above-constructed printer, a controller 180 turns on the power source 170 to supply electricity through the connecting wires 163. The supplied electricity flows along the printed heat wire 140 formed on the insulation layer 130 via the supply terminal 161 and the connecting coat unit 150. Accordingly, the resistance heat generated in the printed heat wire 140 is transmitted to the outer layer 150 to heat the photoreceptor belt 10. Here, as described above, the heating temperature is preferably 40 to 45° C., which can be controlled by the controller 180 such that the controller 180 turns on or off the power source 170 by installing a temperature sensor 190 in the vicinity of the squeegee backup roller 100, as shown in FIG. 3.

Therefore, during the printing operation, the photoreceptor belt 10 is maintained at a heated state in a predetermined temperature range, thereby improving the squeegeeing efficiency.

As described above, in the squeegee apparatus of a liquid electrophotographic printer according to the present invention, during a printing operation, a photoreceptor belt is squeegeed while it is heated at a predetermined temperature. Therefore, the squeegeeing efficiency can be enhanced, causing improvement in the printing quality.

What is claimed is:

1. A squeegee apparatus of a liquid electrophotographic printer having a squeegee roller for pressing a photoreceptor belt to squeegee excess developer liquid from an image developed on a transfer surface of the photoreceptor belt, and a squeegee back up roller for pressing an opposite surface of the photoreceptor belt which is reverse to the transfer surface, the squeegee back up roller disposed opposite to the squeegee roller, the squeegee apparatus comprising a heating means installed in the squeegee backup roller, for heating the photoreceptor belt at a predetermined temperature, wherein the squeegee backup roller consists of a core layer, an outer layer and an insulation layer formed therebetween, and the heating means includes a printed heat wire printed on the insulation layer, a connecting coat unit formed on the outer layer to be electrically connected to the printed heat wire, and an electricity supply unit formed in contact with the connecting coat unit, for supplying electricity to the printed heat wire.

2. The squeegee apparatus according to claim 1, wherein the electricity supply unit includes a holder fixed on a frame, a supply terminal whose one end is fixed on the holder and whose other end is closely coupled to the connecting coat unit, and connecting wires connected to a connection unit provided to the holder to be connected to the supply terminal, for electrically connecting the supply terminal to a power source.

3. The squeegee apparatus according to claim 2, wherein the heating means further includes a temperature sensor for measuring the temperature of the squeegee backup roller.

* * * * *